US005666799A

United States Patent [19]

Phoa et al.

[11] Patent Number: 5,666,799

[45] Date of Patent: Sep. 16, 1997

[54] COOLING DEVICE IN AN OPEN-END SPINNING APPARATUS

[75] Inventors: Tek Tjin Phoa, Raeren, Belgium; Monika Lauber, Aachen, Germany; Dirk Hanuschik, Mönchengladbach, Germany; Burkhard Wulfhorst, Aachen, Germany

[73] Assignee: W. Schlafhorst AG & Co., Moenchengladbach, Germany

[21] Appl. No.: 418,762

[22] Filed: Apr. 7, 1995

[30] Foreign Application Priority Data

Apr. 7, 1994 [DE] Germany ..... 44 11 972.0

[51] Int. Cl.[6] ..... D01H 4/00

[52] U.S. Cl. ..... 57/417; 57/308; 57/406; 57/407

[58] Field of Search ..... 57/406, 407, 411, 57/415, 417, 308

[56] References Cited

U.S. PATENT DOCUMENTS

| | | | |
|---|---|---|---|
| 4,112,663 | 9/1978 | Chrtek et al. | 57/406 X |
| 4,610,134 | 9/1986 | Busch et al. | 57/417 |
| 5,265,406 | 11/1993 | Hofmann et al. | 57/417 |
| 5,321,943 | 6/1994 | Schmid et al. | 57/417 |
| 5,414,985 | 5/1995 | Ball et al. | 57/411 X |

FOREIGN PATENT DOCUMENTS

| | | | |
|---|---|---|---|
| 2159120 | 7/1972 | Germany . | |
| 2410940 | 5/1977 | Germany . | |
| 4007517 | 9/1991 | Germany . | |
| 41 19 264 | 12/1992 | Germany | 57/417 |
| 62-250237 | 10/1987 | Japan | 57/417 |

*Primary Examiner*—William Stryjewski
*Attorney, Agent, or Firm*—Herbert L. Lerner; Laurence A. Greenberg; Werner H. Stemer

[57] ABSTRACT

An open-end rotor spinning machine includes open-end spinning apparatuses each having a rotor housing, a spinning rotor revolving at high rpm in the rotor housing, and a yarn draw-off device extending into the spinning rotor. A cooling device includes a channel plate closing the rotor housing in an operating state. The channel plate has double walls defining a cooling chamber therebetween surrounding the yarn draw-off device. Connection sleeves connect the cooling chamber to a coolant loop.

8 Claims, 2 Drawing Sheets

COOLING DEVICE IN AN OPEN-END SPINNING APPARATUS

BACKGROUND OF THE INVENTION

FIELD OF THE INVENTION

The invention relates to a cooling device in an open-end spinning apparatus, having a spinning rotor revolving at high rpm in a rotor housing, a channel plate closing the rotor housing in an operating state, and a yarn draw-off device extending into the spinning rotor.

Open-end spinning apparatuses with cooling devices are known, for instance, from German Published, Non-Prosecuted Application DE-OS 21 59 120. In that spinning apparatus an attempt is made to keep the climatic conditions as constant as possible in the region of the spinning apparatus, by subjecting the spinning apparatus to two separate air flows. A transport air flow that feeds the individual fibers to the spinning rotor simultaneously acts as coolant air for the yarn draw-off region, while an additional cooling air flow cools a bearing region of the spinning apparatus.

It has long been known that in spinning by the open-end rotor spinning process, the attainable rotor rpm is dependent not only on the yarn tension forces involved but also on the temperature at the yarn draw-off nozzle.

When processing synthetic fibers, especially polyester fibers or mixtures of natural and synthetic fibers, the operating speeds of such open-end rotor spinning machines are therefore limited. Open-end spinning machines cannot be operated at the theoretically attainable high rotary speeds, since damage to the synthetic fibers would then occur from overheating, caused by the heat of friction. It is therefore usual, when synthetic fibers are to be processed, to operate open-end rotor spinning machines at reduced speed, or in other words not at the maximum possible rotor rpm. In comparison with the theoretically attainable rotor rpm, that represents a considerable loss in production, since the production of an open-end rotor spinning machine is directly proportional to the rotor rpm. Although that problem of damage to synthetic. fibers or chemical fibers has long been known, until now no satisfactory solution has been found.

It is known, for instance, from German Published, Prosecuted Application DE-AS 24 10 940, to aim a cooling air flow at a yarn guide funnel, which is comparable in function to a yarn draw-off nozzle. However, that has not led to a usable solution to the problem.

German Published, Non-Prosecuted Applications DE 40 07 517 A1 and DE 41 19 264 A1 also disclose dissipating the heat of friction-that occurs in the region of the yarn draw-off nozzles by means of special heat dissipating nozzles, thereby avoiding damage to the fibers. For technical reasons in spinning, the generation of the heat of friction, which depends on the coefficient of friction, the normal force between the yarn and the contact surface of the draw-off nozzle, and the sliding speed, cannot be decreased substantially. Therefore, in the references mentioned above, yarn draw-off nozzles that have a high heat dissipation value lambda being greater than 80 W/mK are employed. However, the service life of such draw-off nozzles is limited.

SUMMARY OF THE INVENTION

It is accordingly an object of the invention to provide a cooling device in an open-end spinning apparatus, which overcomes the hereinafore-mentioned disadvantages of the heretofore-known devices of this general type.

With the foregoing and other objects in view there is provided, in accordance with the invention, in an open-end spinning apparatus having a rotor housing, a spinning rotor revolving at high rpm in the rotor housing, and a yarn draw-off device extending into the spinning rotor, a cooling device, comprising a channel plate closing the rotor housing in an operating state, the channel plate having double walls defining a cooling chamber therebetween surrounding the yarn draw-off device, and connection sleeves for connecting the cooling chamber to a coolant loop.

The double-walled channel plate with its cooling chamber surrounding the yarn draw-off device and being connected through connection sleeves to a coolant loop, offers the advantage of assuring excellent dissipation of heat in this critical spinning region in a simple way. In this way it becomes possible to use existing highly wear-resistant ceramic nozzles, which have proven themselves many times over in practice, without needing to fear a temperature increase at the draw-off nozzles, which is damaging to the yarn. The use of the double-walled channel plate according to the invention enables continuous temperature stabilization of the spinning process, so that it becomes possible, for instance, to process PES fibers at substantially higher rotor speeds, which leads to a decisive increase in productivity of the spinning machine.

In accordance with another feature of the invention, the cooling chambers of all of the spinning apparatuses of one open-end spinning machine are connected to a common coolant loop for that machine. In such an embodiment, the additional structural expense is within reason and is amortized within the briefest period of time because of the increase in production.

In accordance with a further feature of the invention, the coolant loop is constructed as a closed system or as an open system. While an open system is simpler in terms of its technical structure and therefore is more favorable with regard to cost, the closed system has advantages relative to external factors. For example, no dust particles or the like can get into the coolant.

In accordance with an added feature of the invention, a liquid coolant is used inside the coolant loop. For instance, using water for cooling water offers the advantage on one hand of being highly suitable in terms of its heat conductivity, and on the other hand it presents no problems if any leaks or the like occur.

In accordance with an additional feature of the invention, the extent of temperature stabilization of the channel plates is made adjustable. This is done because the yarn tension force and the temperature at the yarn draw-off nozzle have an influence on one another. It is especially advantageous in this connection to make structural provisions for regulating the flow rate of the coolant.

In accordance with yet another feature of the invention, an adjusting pump is used as the pressure source for the coolant. Through suitable adaptation of the quantity being pumped, the optimal temperature can thus be established at the channel plates.

In accordance with a concomitant feature of the invention, at least one of the hydraulic lines leading to the cooling chamber of the spinning apparatuses has a triggerable flow regulating valve. This kind of embodiment optionally enables individual temperature stabilization of each individual spinning apparatus, which is advantageous, for instance, when the spinning machine is processing multiple batches.

Other features which are considered as characteristic for the invention are set forth in the appended claims.

Although the invention is illustrated and described herein as embodied in a cooling device in an open-end spinning apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
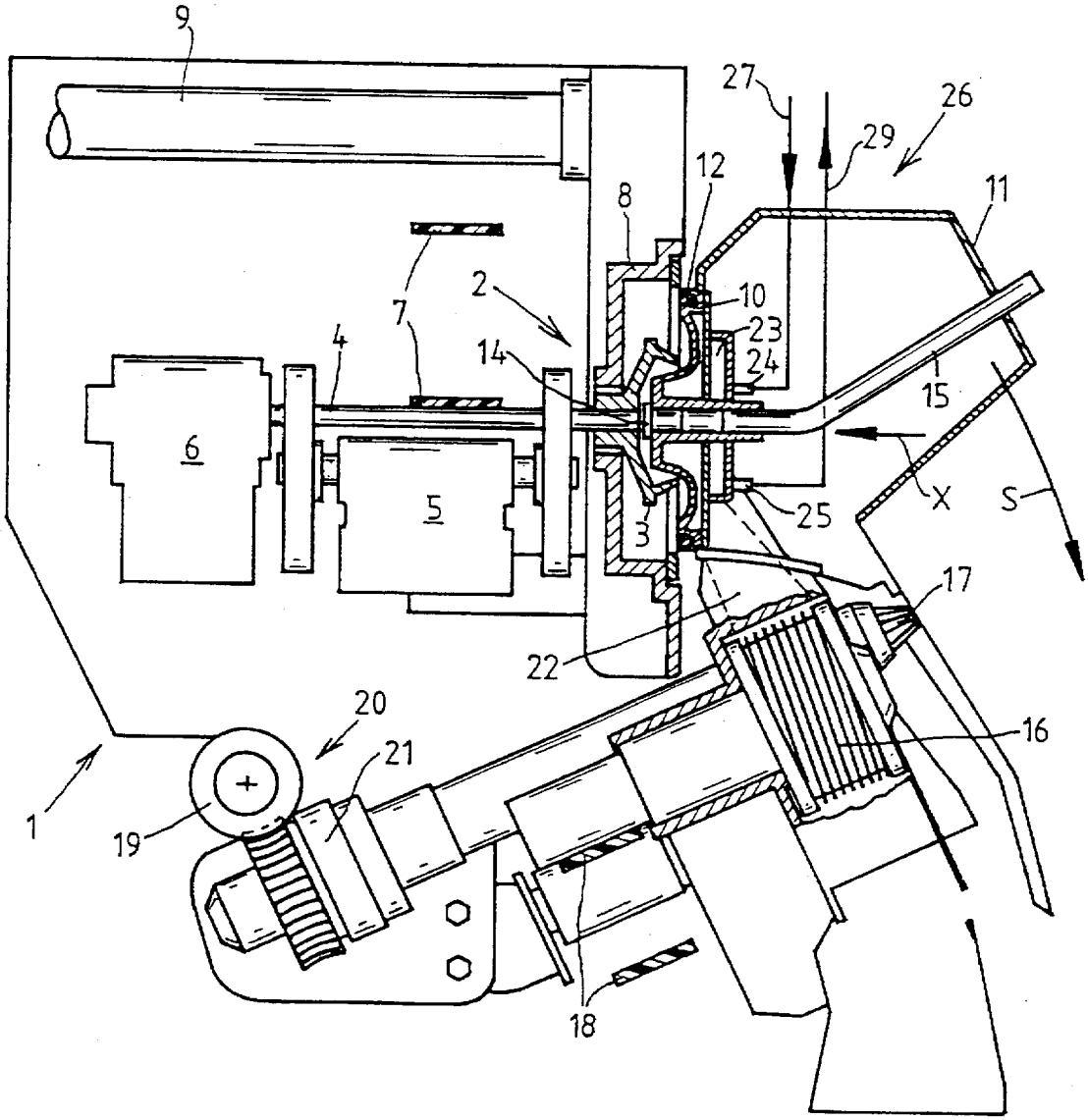
FIG. 1 is a diagrammatic, partly broken-away and partly sectional side-elevational view of an open-end rotor spinning apparatus with a channel plate according to the invention.

Referring now to the figures of the drawing in detail and first, particularly, to FIG. 1 thereof, there is seen an apparatus 1 for open-end rotor spinning which is a component of a non-illustrated spinning machine, that has a number of identical apparatuses 1, which are disposed in a line one next to the other, on both sides. Each apparatus includes a spinning rotor 2, which is assembled from a rotor head 3 and a rotor shaft 4. The rotor shaft 4 is supported in a support disk bearing 5 and its end is supported on a thrust bearing 6. A drive of the spinning rotor is effected through an endless tangential belt 7.

The rotor head 3 revolves at high rotary speed inside a rotor housing 8. The rotor housing 8 communicates with a non-illustrated negative pressure source through a negative pressure line 9 and is closed at the front by a channel plate 10. The channel plate 10 is disposed as usual in a cover 11, which is hinged to fold in a direction S in a manner that is not shown in further detail and which gives access to the spinning rotor 2 in the folded-open state.

Figure 3:
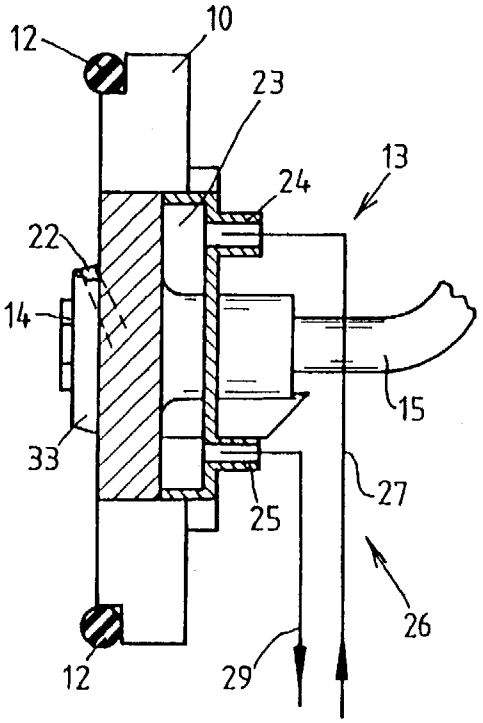
FIG. 3 is a sectional view of the channel plate, which is taken along a line III—III of FIG. 2, in the direction of the arrows.
Figure 2:
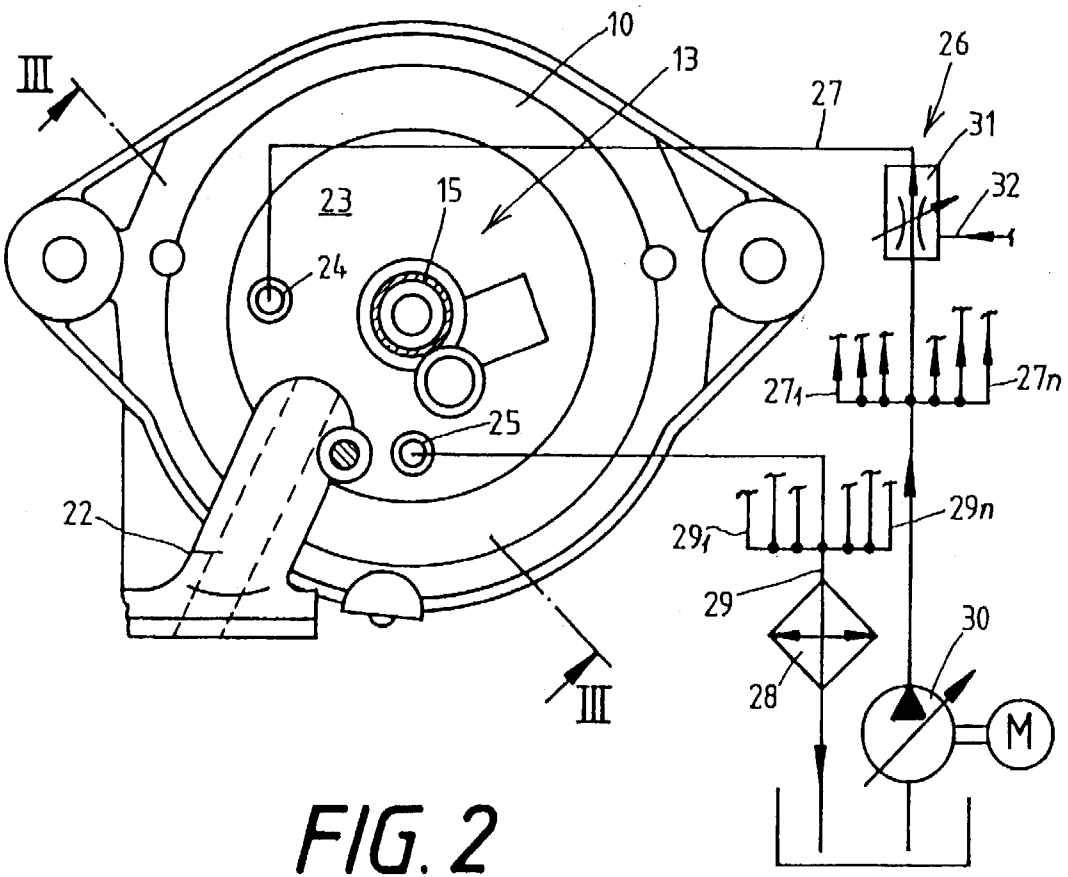
FIG. 2 is a front-elevational view of the channel plate according to the invention, as seen in a direction X of FIG. 1.

As is seen in FIGS. 1, 2 and 3, the channel plate 10, which rests in air-tight fashion against the rotor housing 8 through a seal 12, protrudes with a channel plate extension 33 part-way into the spinning rotor 2 and moreover has a yarn draw-off device, designated overall by reference numeral 13, which in detail includes a yarn draw-off nozzle 14 and a small draw-off tube 15 on the end.

The spinning apparatus 1 also includes a delivery and opening device 16, 17 having an opening roller 16, which is equipped with needles or teeth and is driven through an endless tangential belt 18, as well as a delivery roller 17 being driven through a drive shaft 19 having the same length as the spinning machine. The delivery roller 17 is connected to the drive shaft 19 through a worm gear 20 and an electromagnet coupling 21. Fibers which are opened from non-illustrated sliver by the delivery and opening device 16, 17 pass by way of a fiber guide channel 22 into the spinning rotor 2, where they are deformed into a yarn that is drawn off through the yarn draw-off device 13.

Since frictional heat occurs while the yarn is being drawn off in the region of the yarn draw-off nozzle 14 as already explained above, the channel plate 10 is constructed with double walls, as is shown particularly clearly in FIG. 3. This means that the channel plate 10 has a cooling chamber 23 on its back side, which is connected through connection sleeves, branches or necks 24, 25 at the back to a coolant loop 26 belonging to the spinning machine. The connection sleeves 24 and 25 respectively communicate through respective hydraulic lines 27 and 29 with a coolant pump 30 and a heat exchanger 28. Hydraulic lines $27_1$–$27_n$ and $29_1$–$29_n$ indicate that the coolant pump 30 and the heat exchanger 28 are connected to a multiplicity of identically constructed open-end spinning machines. The coolant pump is preferably an adjusting pump, so that the quantity of coolant being pumped can be adjusted exactly. According to an alternative or additional feature, a flow regulating valve 31 that is triggerable in defined fashion through a control line 32 can be incorporated into the hydraulic line 27.

The open system shown in the exemplary embodiment represents merely one variant embodiment of the invention. Naturally it may also be advantageous to construct the coolant loop 26 as a closed system.

According to a further feature of the invention, the heat exchanger 28 may also be positioned downstream of the coolant pump 30, or the flow regulating valve 31 may be a component of the hydraulic line 29. What is essential to the invention for continuous temperature stabilization of the spinning process is the disposition of a cooling chamber, through which coolant flows, in the region of the yarn draw-off device.

We claim:

1. An open-end spinning apparatus, comprising a rotor housing, a spinning rotor revolving at high revolutions in the rotor housing, and a yarn draw-off device extending into the spinning rotor, and a cooling device for cooling said yarn draw-off device, said cooling device including a channel plate for covering the rotor housing in an operating state, said channel plate having double walls defining a cooling chamber therebetween surrounding said yarn draw-off device, and a coolant loop communicating with said cooling chamber.

2. An open-end rotor spinning machine comprising individual open-end spinning apparatuses and a common coolant loop, each of said spinning apparatuses having a rotor housing, a spinning rotor revolving at high revolutions in said rotor housing, and a yarn draw-off device extending into said spinning rotor, and a cooling device connected in said common coolant loop, said cooling device including channel plates each for covering a respective one of said rotor housings in an operating state, said channel plates each having double walls defining a cooling chamber therebetween surrounding a respective one of said yarn draw-off devices.

3. The machine according to claim 2, wherein said coolant loop of the spinning machine is a closed system.

4. The machine according to claim 2, wherein said coolant loop of the spinning machine is an open system.

5. The machine according to claim 2, wherein said coolant loop contains a liquid coolant as a cooling agent for dissipating heat of friction occurring in the vicinity of the yarn draw-off devices.

6. The machine according to claim 2, including an adjustable coolant pump for adjusting a flow rate of the coolant in a defined manner and wherein and extent of temperature stabilization of said channel plates is adjustable by regulating the flow rate of coolant in the coolant loop.

7. The machine according to claim 6, including connection lines leading to said cooling chambers of the spinning apparatuses, and a triggerable flow regulating valve disposed in at least one of said connection lines.

8. The machine according to claim 2, including connection sleeves for connecting said cooling chambers to said common coolant loop.

* * * * *